US005451005A

United States Patent [19]

Lochbronner

[11] Patent Number: 5,451,005

[45] Date of Patent: Sep. 19, 1995

[54] BOBBIN EVACUATION ON A MOVABLE CONVEYOR BELT

[75] Inventor: Hubert Lochbronner, Lenting, Germany

[73] Assignee: Rieter Ingolstadt Spinnereimasicnenbau AG, Ingolstadt, Germany

[21] Appl. No.: 48,855

[22] Filed: Apr. 19, 1993

[30] Foreign Application Priority Data

May 2, 1992 [DE] Germany ..... 42 14 683.6

[51] Int. Cl.[6] ..... B65H 63/00; B65H 54/02

[52] U.S. Cl. ..... 242/35.5 A; 57/90; 57/281; 198/358; 242/36

[58] Field of Search ..... 242/35.5 A, 36; 57/281, 57/90; 198/358

[56] References Cited

U.S. PATENT DOCUMENTS

| | | | |
|---|---|---|---|
| 4,582,270 | 4/1986 | Asai et al. | 242/35.5 A |
| 5,011,092 | 4/1991 | Kallmann | 242/35.5 A |

FOREIGN PATENT DOCUMENTS

| | | |
|---|---|---|
| 0342527 | 5/1989 | European Pat. Off. . |
| 3731125 | 5/1988 | Germany . |
| 3912488A1 | 10/1990 | Germany . |
| 2196995 | 5/1988 | United Kingdom . |

*Primary Examiner*—Daniel P. Stodola
*Assistant Examiner*—William Stryjewski
*Attorney, Agent, or Firm*—Dority & Manning

[57] ABSTRACT

A device and method are provided for bobbin evacuation on a movable conveyor belt. The invention particularly concerns a process for automatic evacuation of wound-up bobbins in a spinning, winding or twisting machine equipped with work stations on both sides, on a movable conveyor belt which is installed in the longitudinal center of the machine, whereby the bobbins can be replaced randomly. A device is described to carry out the process. It is a characteristic of the invention that the conveyor belt moves at a continuous speed and in that the state of occupancy of the conveyor belt is stored in a computer, whereby the automatic travelling carriage at the spinning station finds the location which is free at the moment through the computer during bobbin replacement and whereby the automatic travelling carriage deposits the bobbin on the continuously moving conveyor belt when the signal is given that the location is free. The computer, which is equipped with a ring counter with parallel input and output, is a part of the machine center of the spinning section. The drive shaft or the deflection roller of the conveyor belt is connected to a pulse generator which supplies the pulses to the computer.

21 Claims, 4 Drawing Sheets

BOBBIN EVACUATION ON A MOVABLE CONVEYOR BELT

BACKGROUND OF THE INVENTION

The instant invention relates to a process for automatic evacuation, on a movable conveyor belt, of wound bobbins of a spinning, winding or twisting machine with work stations on both sides thereof, the conveyor belt being positioned in the longitudinal center of the machine so that a random replacement of bobbins can be carried out. A device for carrying out the process is also provided.

DE-OS 39 12 513 describes the arrangement of one single conveyor belt in the longitudinal center of the machine. Bobbins are placed on the conveyor belt from both sides of the machine after a bobbin replacement. When the machine initiates a bobbin replacement on the opposite side after drop-off of a bobbin of the conveyor belt, the automatic travelling carriage checks the bobbin occupancy of the conveyor belt in front of that spinning station to determine the state of either "occupied" or "free". The automatic travelling carriage utilizes sensors functioning without physical contact for this verification, the sensors being designed in the form of reflection light barriers. If the location on the conveyor belt is already occupied due to the drop-off of a bobbin, the automatic travelling carriage recognizes by means of the sensors what the state of the drop-off location on the belt is and transmits a control signal which causes the conveyor belt to continue moving in increments until a free location for drop-off at the location concerned is available and the initiated bobbin replacement can be carried out.

The solution described has the disadvantage that the automatic travelling carriage travelling in front of the spinning stations must be equipped additionally with sensing devices in order to recognize whether a drop-off location is free on the conveyor belt. The reflection light barriers are furthermore subject to malfunctions due to dirt caused by flying fibers and require periodic maintenance for that reason. It is another advantage that the bobbins produced in a random sequence are dropped off on the conveyor belt and are removed without any information concerning quality and work station origin being transmitted to downstream conveying and processing machines. DE-OS 37 31 125 describes a similar solution.

Other state-of-the-art solutions provide the bobbins during bobbin removal additionally with machine-readable codes (DE-OS 39 12 488) or labels (EP 342 527). The technical effort required to read the codes and to affix labels on the yarn body or on the bobbin former is, however, a disadvantage.

OBJECTS AND SUMMARY OF THE INVENTION

It is a principal object of the instant invention to avoid the outlay in equipment and technology which is conventionally used during bobbin replacement in order to recognize free drop-off locations on a conveyor belt and to improve the efficiency of random bobbin removal at the same time.

Additional objects and advantages of the invention will be set forth in part in the description which follows, and in part will be obvious from the description, or may be learned by practice of the invention.

According to the present invention, a memory zone, into which all the data concerning the individual bobbins being produced at the moment is entered, is defined in a known manner in the computer system of the machine, the central machine control. This memory zone is designated here as Memory Zone I. The number of its memory locations is equal to at least the number of work stations of the machine.

In this machine control center an additional storage zone, new Storage Zone II, representing the possible drop-off locations (these are depositing fields) on the conveyor belt of the bobbins to be replaced, is provided. For this, a stopped conveyor belt is divided up into apparent drop-off fields. The width of a drop-off field is equal to the width of the work station. Thus a drop-off field of two work stations facing each other is claimed for work stations provided on both sides of the conveyor belt. The number of drop-off fields is thus equal to one-half of all work stations. The belt can be made wider by at least one drop-off field which represents a necessary buffer location before a deposited bobbin is taken over by the following buffer memory or conveying system. The number of drop-off fields, as well as buffer locations on the belt, are represented as the total number of memory locations of the new Memory Zone II. The image is created by a ring counter with address pointer. The address pointer always points to the imaged drop-off field which at the moment represents the removal location and is ready for removal. The address pointer therefore always points to the location which is at that moment at the end of the belt. Therefore, when the conveyor belt is moved, the address pointer of Memory Zone II also moves. With each movement of the conveyor belt, where a drop-off field exceeds a work station division, the address pointer of the new memory zone II is incremented by one memory location. The cycle of movement of the address pointer is synchronized with the rhythm of movement of the conveyor belt.

When a work station has signalled a bobbin replacement, the automatic travelling carriage positions itself in front of this work station. The automatic travelling carriage interrogates the memory zone II in interaction with a computer. Since the address pointer always points to the belt end, a counter of the computer calculates the distance between the drop-off field of the moment and the belt end. Counting continues by this difference from the pointer position at the moment, and the present memory location representing the occupancy condition of the drop-off field in front of the work station in question is thus found.

Two storage locations from the memory zone I are assigned to each storage location of the new memory zone II for machine origin and quality data of the two work stations facing each other. The addresses of the memory locations for machine origin and quality data of the work stations are fixed.

When a bobbin replacement is then required at an actual work station the automatic travelling carriage interrogates the machine center in order to ascertain the occupancy condition of the drop-off location of the conveyor belt which is in front of the work station at that moment.

This is ascertained by the machine center which, starting from the appertaining memory location of the corresponding work station, interrogates the assigned memory location of the new memory zone (which represents a new drop-off field on the conveyor belt) about the memory contents at that moment. If the answer to the interrogation is that the memory contents characterize the drop-off field of the moment as "free" the bobbin is immediately dropped off on the conveyor belt. Otherwise the automatic travelling carriage must wait until the drop-off field changes and a new interrogation can be started. For this purpose the conveyor belt moves at a continuous speed.

When a bobbin is dropped off on the conveyor belt, the memory location of the new memory zone II which represents the depositing position is, at the same time, described by the information that this drop-off field is "occupied". If the bobbin is later transferred from the buffer location (end of belt) to a subsequent buffer storage or conveyor system, i.e. the address pointer has just left the storage location, the storage contents are again described as "free". First however, the storage contents concerning origin and quality are transmitted to other computer systems of downstream buffer memories or conveyor systems.

It is characteristic for the data management in the new memory zone that, after having been read in, the data contents are again read out after a time delay (corresponding to the time during which the bobbin remains on the belt) and are again characterized as "free".

In an embodiment of the device according to the invention, the computer is provided at the machine center of the spinning section. The deflection roller of the conveyor belt is provided with mechanical coupling to a pulse generator. This pulse generator supplies the impulses to the computer. The computer may be equipped with a ring counter with parallel input/output to carry out the process. The process can however also be carried out by software techniques which use, for example, the operating principle of said ring counter.

With this bobbin removal system it is an advantage that the conveyor belt can be stopped during transportation without losing the desired tracking of the bobbin. It is an additional advantage that the automatic travelling carriage is able to query the machine center whether the replacement of a full bobbin can be carried out or whether the conveyor belt is occupied at the location in question at that moment. The expenses involved for the automatic travelling carriage at the present state of the art in order to recognize a free drop-off position on the conveyor belt are avoided.

The drawings show an embodiment of the invention and, together with the description, serve to describe and explain a preferred embodiment of the invention.

Figure 1:
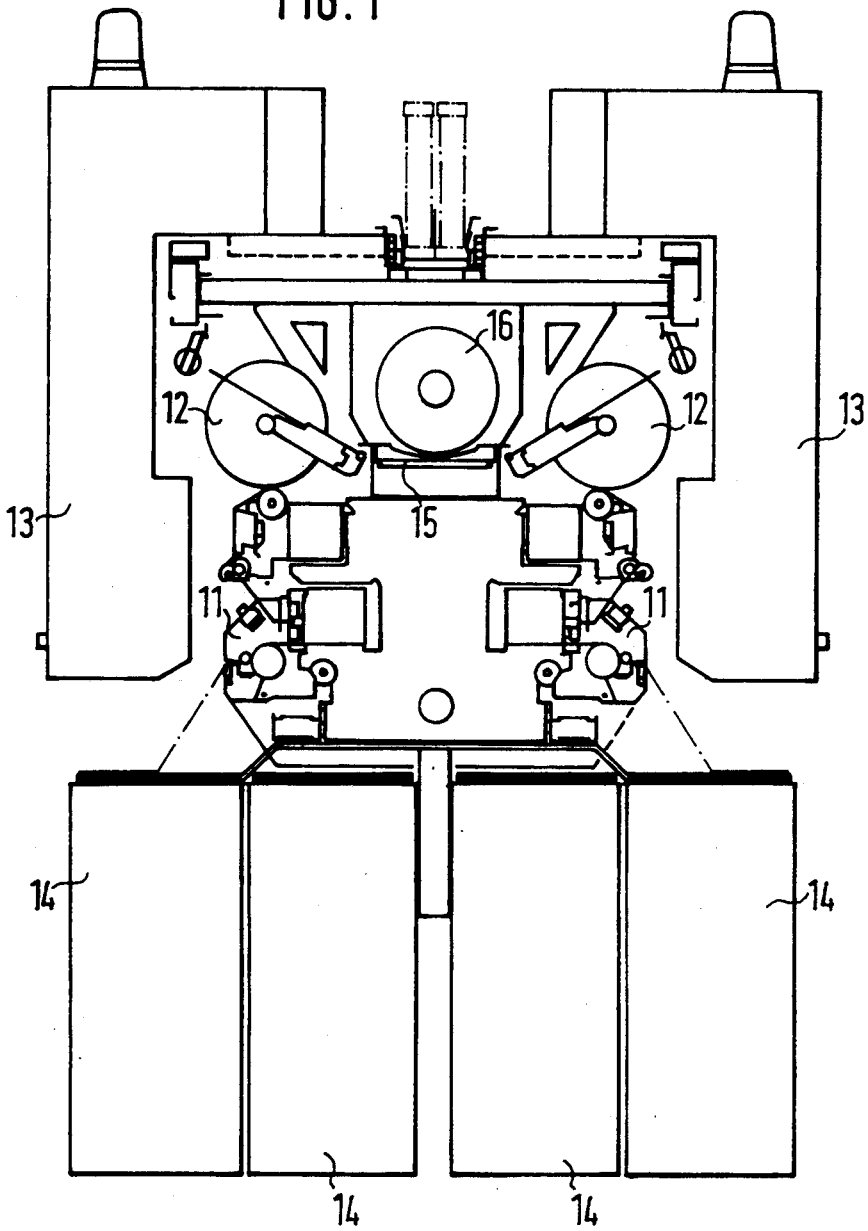
FIG. 1 shows a schematic cross-section of an open-end spinning machine.

FIGS. *2a–e* show the interaction an between open-end spinning machine and machine center.

DESCRIPTION OF THE PREFERRED EMBODIMENTS

Reference will now be made in detail to the presently preferred embodiments of the invention, one or more examples of which are illustrated in the accompanying drawings. Each example is provided by way of explanation of the invention, not limitation of the invention. The numbering of components in the drawings is consistent throughout the application, with the same components having the same number in each of the drawings.

FIG. 1 schematically shows the spinning boxes 11 of a spinning machine located on either side of the machine. The spinning cans 14 are standing below the spinning boxes. Above each spinning box, a cross-wound bobbin 12 can be recognized on either side. The conveyor belt 15 is installed between the bobbin supports. A dropped-off bobbin 16 can be seen on the conveyor belt. The automatic travelling carriage 13 travels on a rail system above the winding stations. The automatic travelling carriage can be used separately on either machine side as shown here.

In FIGS. *2a–2e*, the open-end spinning machine can be seen in schematic top view at the left side of each drawing. The automatic travelling carriage WA travels along the long sides of the machine. The automatic travelling carriage WA can thus be positioned before each one of the work stations 1 to 10 and is able to carry out the bobbin replacement at each work station. The work stations are 10 spinning stations in the present example. The single conveyor belt is laid out in the longitudinal center of the machine. This conveyor belt is an endless belt which is constantly moved in the conveying direction by an electric drive. The drive is not shown, but only the active connection between belt drive and pulse generator TG is shown. This pulse generator TG is mechanically coupled to the drive shaft or to the deflection roller. The deflection roller is preferred because it is much freer of slip than the belt. The impulses of the pulse generator are transmitted to the computer of the machine center. The computer utilizes these pulses to ascertain the width of the drop-off field from the pulses and to control the incrementing of an address indicator. The computer works alternately with a memory zone I and with a new memory zone II.

In FIG. *2a* the automatic travelling carriage WA is standing in front of the spinning station 3. For better understanding of the invention, the drop-off fields on the conveyor belt are marked off in the figure. In practical execution, the marking of the fields on a conveyor belt is not required. In this example six drop-off fields, field A to field F, can be seen. The automatic travelling carriage WA has a separate connection to the machine center. The machine center is a computer system. A memory zone I and a new memory zone II of the machine center are schematically indicated, as well as the computer with various connections via data bus (FIG. *2a*). The memory zone II is made in form of a ring counter with address indicator. Additional elements or components of the computer system are not shown, as they do not contribute to the understanding of the present invention.

The automatic travelling carriage WA is stopped before the spinning station 3 in order to carry out a bobbin replacement. The bobbin replacement is to be carried out and the bobbin is to be dropped on the conveyor instantly. Before the bobbin is dropped on the conveyor belt, the automatic travelling carriage WA initiates a query which goes via the data bus to the memory zone II.

For this purpose the correct memory location must be found in the memory zone II. The address indicator is pointing to memory location F′ which characterizes the belt end, i.e. buffer space F. The counter of the computer finds the distance between the present drop-off field in front of the spinning station 3 and the end of the belt, i.e. the buffer location. The difference is equal to three counting units. Starting at the belt end, storage location F′, the counter counts back three counting units and memory location C' is found. The contents of memory location C' are read by the machine center and the result, i.e. "occupied", is transmitted to the automatic travelling carriage WA. The automatic travelling carriage WA thus recognizes that the drop-off field in front of the spinning station 3 is "occupied".

The automatic travelling carriage WA waits and again initiates a query of memory zone II because the belt has moved on in the meantime.

Figure 2A:
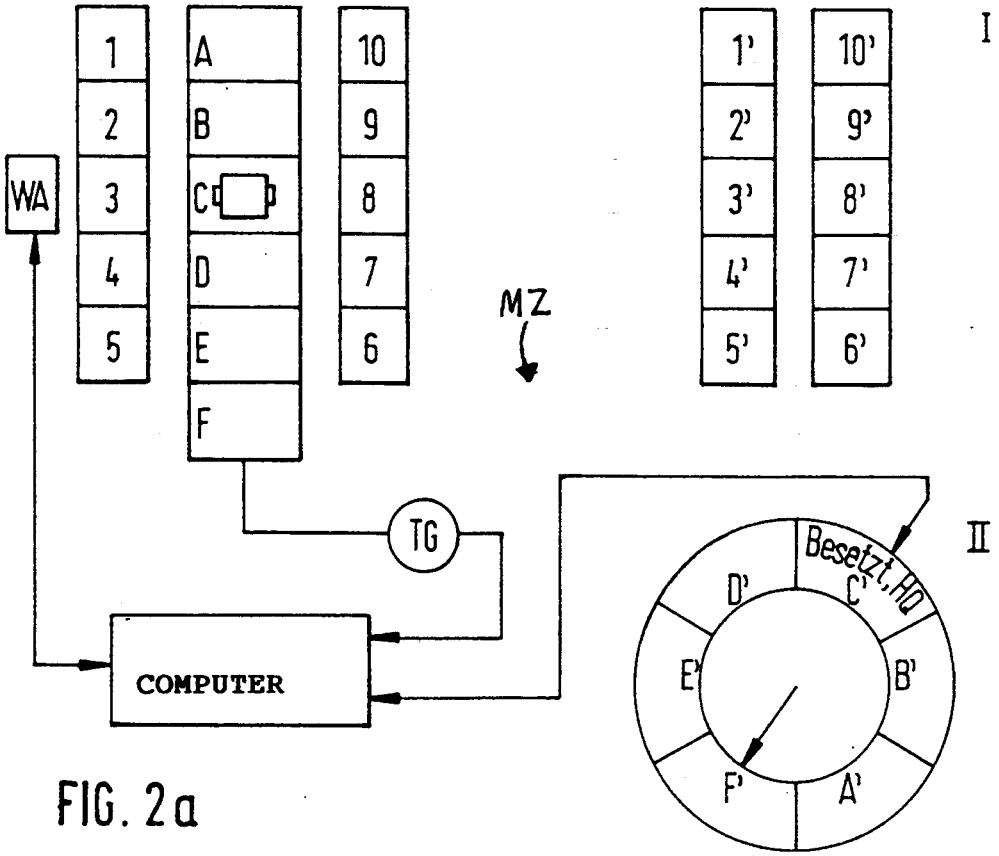
Figure 2B:
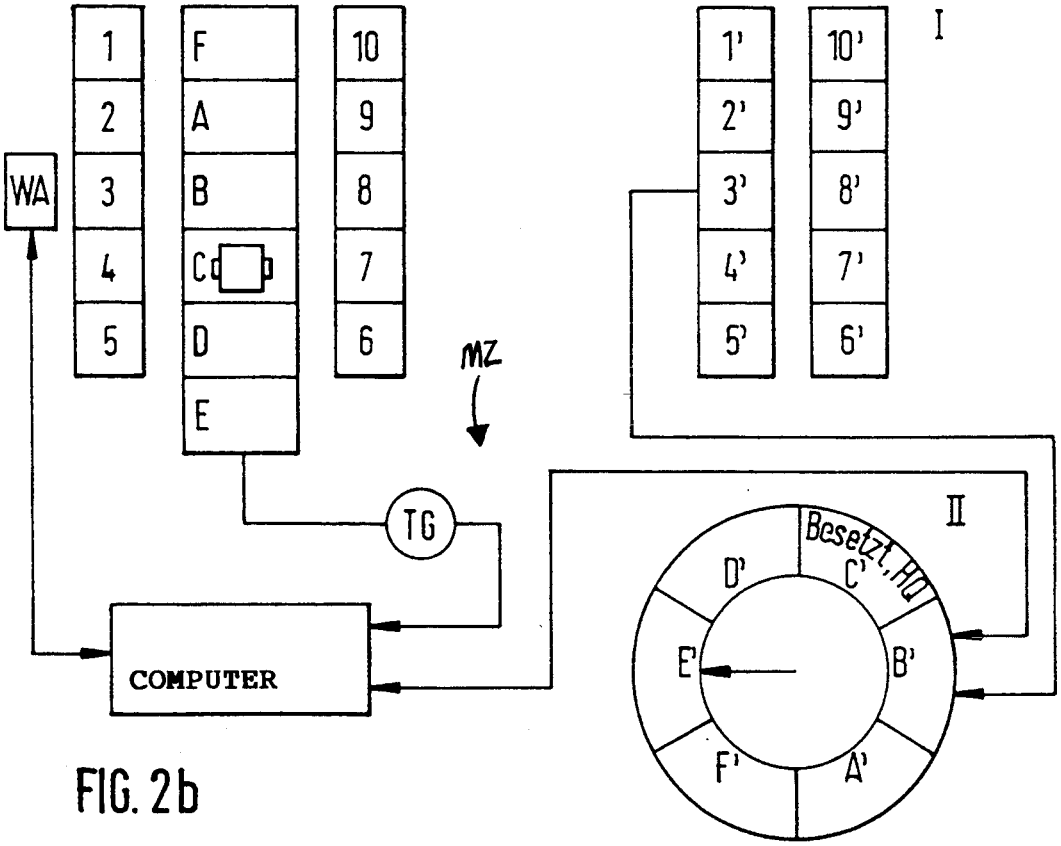

The new situation is represented in FIG. 2*b*. During the wait period, the conveyor belt has moved forward by one drop-off field. This situation is reproduced by the address indicator in the ring memory. The address indicator indicates the belt end and thereby memory location E' as being the belt end. Since the automatic travelling carriage WA still stands in front of the spinning station 3, a query of the memory zone II via the machine center elicits the response that the memory location B' three counting units further, applies to the spinning station 3. The answer to the query of the memory location B' is that it is not occupied. Immediate deposit of the bobbin on drop-off field B is carried out. At this moment of bobbin drop-off on the drop-off field B, the origin and quality data HQ of this bobbin, which were stored in memory zone I in memory location 3' are transmitted into memory location B'. Memory location B' therefore contains:

The state of occupation: Occupied

The origin and quality data of the bobbin.

Figure 2C:
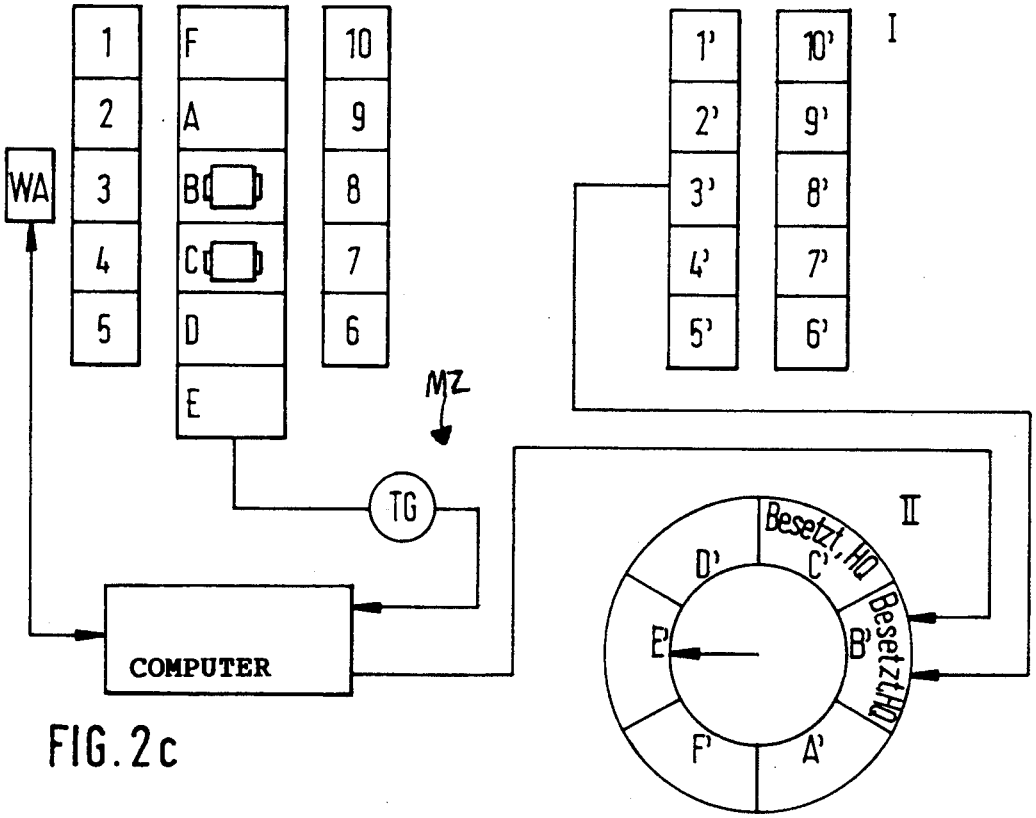

This situation is shown in FIG. 2*c*.

Figure 2D:
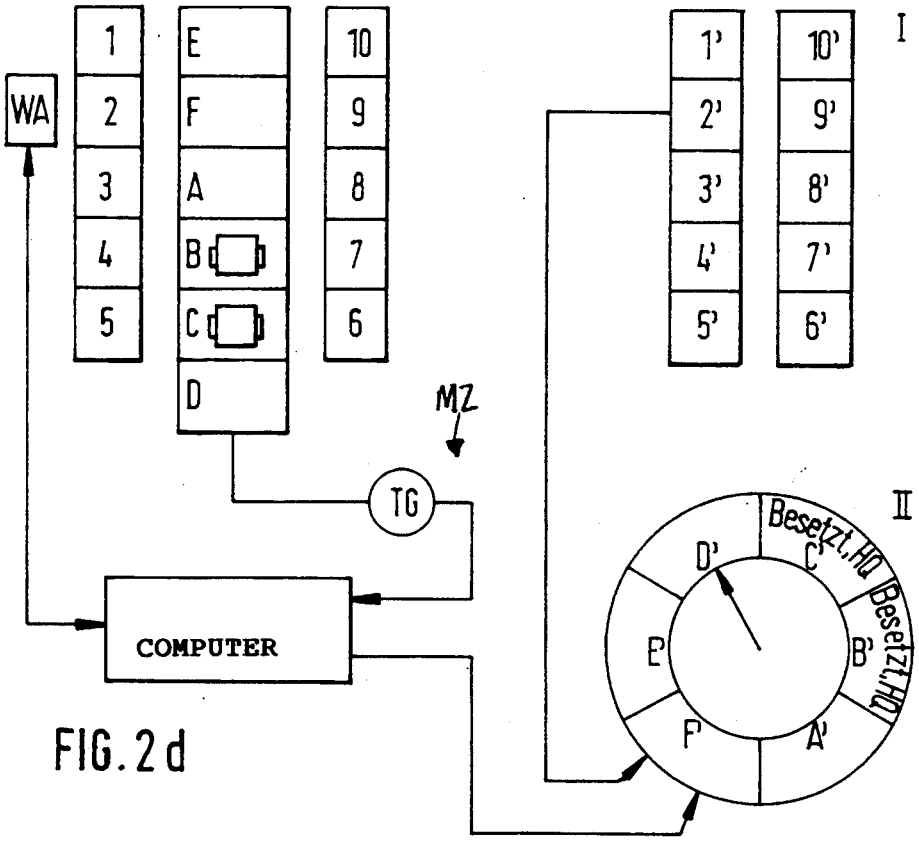

In the meantime the belt has moved on. The address indicator was incremented accordingly by one memory location (FIG. 2*d*). The automatic travelling carriage WA is standing in front of spinning station 2, which has signalled for a bobbin replacement. The automatic travelling carriage WA again queries the memory zone II via the machine center on the state of occupation of the belt. The counter finds that the corresponding memory location is now four counting units further in pointer direction. This is memory location F'. Memory location F' is a memory location designated as "Free". The memory location F' represents the drop-off field F located in front of the spinning station 2. The automatic travelling carriage WA recognizes, from querying the memory zone II, that the drop-off field F in front of spinning station 2 is "Free". The bobbin is then immediately dropped off on drop-off field F. At the same time the machine center MZ describes the memory location F' in the memory zone II as "occupied" and takes the origin and quality data HQ of the spinning station 2 from the memory zone I. For this purpose the origin and quality data HQ of the bobbin are transmitted from the memory zone I, memory location 2' into memory zone II, memory location F'.

Figure 2E:
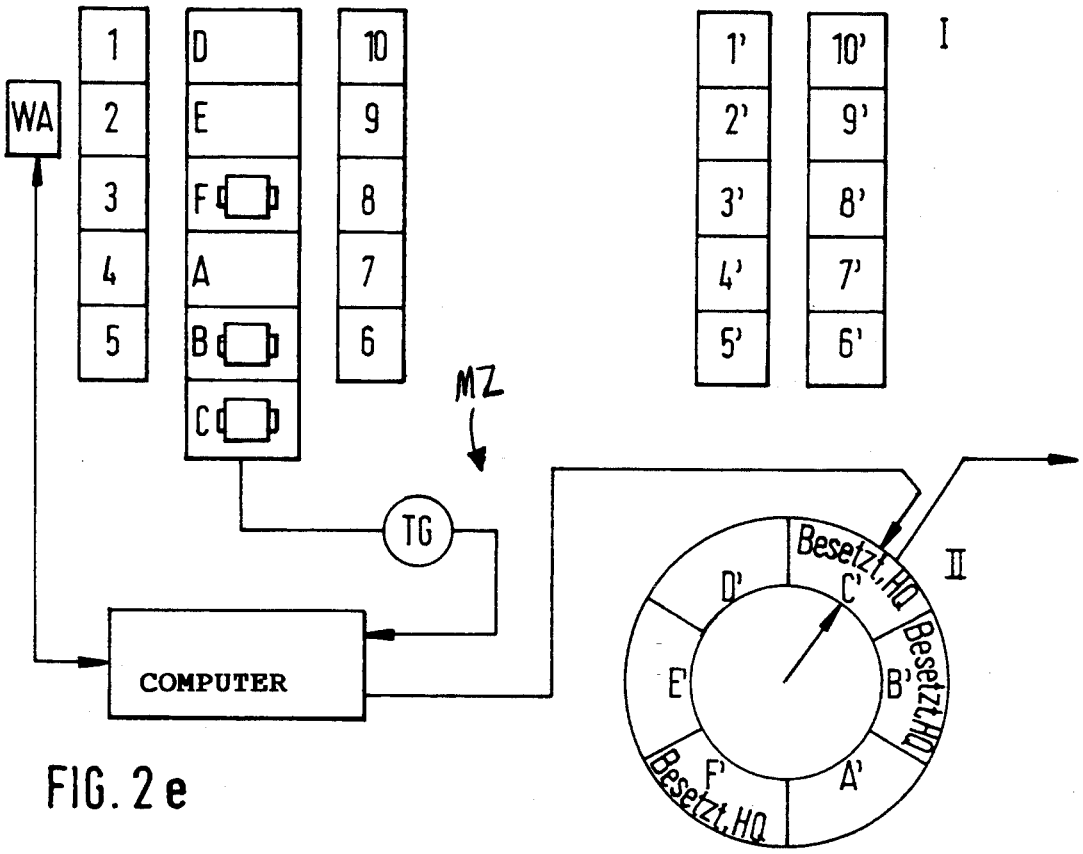

FIG. 2*e* shows that the bobbin on drop-off field C has reached the buffer location and thereby the end of the belt. This is reflected in the position of the address indicator which is now pointing to memory location C'. When the address indicator is incremented to memory location B' the emptied memory location C' is characterized by the computer as being "free". All data were first transmitted to a buffer memory or to a conveying system, i.e. to the location at which the bobbin is actually present.

It will be apparent to those skilled in the art that various modifications and variations can be made in the present invention without departing from the scope or spirit of the invention. For instance, features illustrated or described as part of one embodiment, can be used on another embodiment to yield a still further embodiment. Thus, it is intended that the present invention cover such modifications and variations as come within the scope of the appended claims and their equivalents.

I claim:

1. A process for bobbin evacuation on a movable conveyor belt of a textile machine having a plurality of adjacent work stations and an automatic travelling carriage configured to travel along the work stations and to stop at individual work stations for random bobbin replacement, said process comprising the steps of:

continuously driving the conveyor belt along the work stations during normal operation and bobbin replacement;

determining and storing in a machine computer the occupancy conditions of the portions of the conveyor belt adjacent the work stations;

stopping the automatic travelling carriage at a work station of the textile machine wherein a bobbin replacement has been called for;

interrogating the machine computer with the automatic travelling carriage as to the occupancy condition of the conveyor belt adjacent the work station until the occupancy condition of the conveyor belt is free;

informing the automatic travelling carriage from the machine computer when the occupancy condition of the conveyor belt adjacent the respective work station is free wherein the automatic travelling carriage deposits the respective work station bobbin onto the free position of the conveyor belt and;

updating in the machine computer the occupancy condition of the conveyor belt adjacent the respective work station.

2. The process as in claim 1, wherein said continuously driving the conveyor belt includes driving the conveyor belt at a relatively constant speed.

3. The process as in claim 1, wherein said determining and storing step includes analytically defining the conveyor belt into drop-off fields which are essentially equal to the width of a work station, each drop-off field corresponding to a memory location for an individual work station assigned in a first storage memory of the machine computer whereby each work station has an assigned memory location in the first storage memory of the machine computer.

4. The process as in claim 3, including storing the occupancy condition of the drop-off fields in their respective memory locations in the machine computer.

5. The process as in claim 3, wherein said interrogating step includes using a pulse generator to detect the movement of the conveyor belt and using pulses generated by the pulse generator to increment an address counter operating with the first storage memory in the machine computer, the address counter pointing to the memory locations in the first storage memory in synchronism with movement of the conveyor belt.

6. The process as in claim 3, wherein said determining and storing step further includes defining at least one additional drop-off field on the conveyor belt in addition to the drop-off fields assigned to the work stations, the at least one additional drop-off fields serving as buffer drop-off fields.

7. The process as in claim 3, including providing a second storage memory in the machine computer also having memory locations assigned to each drop-off field and storing collected data related to the work station bobbins in the second storage memory locations.

8. The process as in claim 7, including transferring the stored collected data from the second storage memory to the respective corresponding memory location in the first storage memory at the time of transferring the bobbin with the automatic travelling carriage from the work station once a free position of the conveyor belt adjacent the work station corresponding to a free drop-off field is caused by movement of the conveyor belt.

9. The process as in claim 8, including storing collected data in the second storage memory related to the machine origin and quality of the bobbin.

10. The process as in claim 5, including transmitting the collected data which was transferred to the first storage memory to another computer system during evacuation of the bobbin from the belt.

11. The process as in claim 10, including designating drop-off fields as free in the first storage memory locations as the memory locations are incremented past the address pointer.

12. The process as in claim 7, including using an address counter with the first storage memory which is incremented by pulses from a pulse generator associated with the movement of the conveyor belt, the address counter thereby pointing to the memory locations in the first storage memory in synchronism with movement of the conveyor belt and transmitting the data from the memory location which is pointed by the address counter.

13. The process as in claim 12, including transferring the data from the memory location to another computer system.

14. The process as in claim 12, including clocking the rate of the conveyor belt and correlating the time delay of data in the memory locations until read out thereof to the speed of the conveyor belt.

15. A bobbin evacuation system in combination with a textile machine utilizing an automatic travelling carriage for servicing work stations of said textile machine, comprising:

a continuously driven conveyor belt disposed adjacent said textile machine work stations, said conveyor belt configured for receiving bobbins from said work stations;

a machine computer having a means for determining and storing the occupancy conditions of drop-off fields of said conveyor belt adjacent said work stations;

means for interrogating said machine computer from said automatic travelling carriage as to the occupancy condition of said conveyor belt adjacent a selected said work station, said interrogating means configured to repeat interrogating until the occupancy condition of said conveyor belt adjacent said selected work station is free;

said machine computer in communication with said automatic travelling carriage and configured to control said automatic travelling carriage to deposit a bobbin from said selected work station onto said conveyor belt once the occupancy condition of said conveyor belt adjacent said selected work station is free; and said machine computer further comprising updating means for updating said means for determining and storing as to the occupancy condition of said conveyor belt adjacent said selected work upon deposition of said bobbin by said automatic travelling carriage.

16. The system as in claim 15, wherein said means for determining and storing comprises a ring counter with an associated address indicator, said ring counter defining memory locations corresponding to the conveyor belt drop-off fields.

17. The system as in claim 16, wherein said ring counter comprises parallel input and output data capabilities.

18. The system as in claim 16, further comprising a pulse generator associated with said ring counter, whereby pulses from said pulse generator are used to clock said address indicator in synchronism with the speed of the conveyor belt.

19. The system as in claim 15, wherein said textile machine comprises a central operating computer, said machine computer being a portion of the central operating computer.

20. The system as in claim 15, wherein said machine computer comprises a control computer for the automatic travelling carriage.

21. The system as in claim 15, wherein said machine computer further comprises a memory which stores data relating to the origin and quality of said bobbins deposited from said work stations onto said drop-off fields.

* * * * *